United States Patent [19]
Kessl
[11] 4,230,490
[45] Oct. 28, 1980

[54] PROCESS FOR PRODUCING CAST IRON

[76] Inventor: Werner Kessl, Nr. 10a, 8481 Bärnwinkel, Fed. Rep. of Germany

[21] Appl. No.: 906,763

[22] Filed: May 16, 1978

[30] Foreign Application Priority Data

May 26, 1977 [DE] Fed. Rep. of Germany ..... 2723870

[51] Int. Cl.[2] ..... C21C 33/08
[52] U.S. Cl. ..... 75/130 B; 75/53; 75/130 R
[58] Field of Search ..... 75/53, 130 R, 130 B; 164/57

[56] References Cited

U.S. PATENT DOCUMENTS

| | | | |
|---|---|---|---|
| 3,802,680 | 4/1974 | Anders | 75/53 |
| 3,833,361 | 9/1974 | Kusaka | 75/130 B |
| 4,022,613 | 5/1977 | Haley | 75/53 |

*Primary Examiner*—P. D. Rosenberg
*Attorney, Agent, or Firm*—Toren, McGeady and Stanger

[57] ABSTRACT

A method for making cast iron containing globular or nodular graphite wherein molten iron is poured into magnesium or a magnesium master-alloy which is covered with particulate silicon carbide and iron chips. This covering results in minimization of the oxidation of the magnesium and is also advantageous in maintaining the temperature of the molten iron.

9 Claims, No Drawings

PROCESS FOR PRODUCING CAST IRON

BACKGROUND OF THE INVENTION

1. Field of the Invention

The invention relates to a process for producing cast iron containing globular or nodular graphite.

2. Description of the Prior Art

Methods for the production and the principal advantages of cast iron containing globular graphite have been known for a long time, particularly, since the works of Gagnebin. Cast iron containing globular graphite is generally produced by treating magnesium or a magnesium master-alloy with molten iron which can be obtained by melting in any melting furnace. The magnesium master-alloys used in this case contain, in most cases, iron, nickel, calcium and silicon as the alloy partners. The amount of magnesium or magnesium master-alloy to be added is substantially influenced by the considerable amount of magnesium oxidation which takes place. A very significant oxidation occurs because the temperature of the molten base iron is considerably higher than the relatively low boiling point of the magnesium or, respectively, the vapor pressure of the magnesium in the master-alloy exceeds the normal atmospheric pressure of the molten iron.

Considerable effort has been made to counteract this oxidation. For example, pressurized ladles have been developed, i.e., pouring ladles which can withstand an internal working pressure of more than 20 atmospheres and which can be tightly closed. In most cases, these ladles additionally have a special lining depending on the nature of the melt. Furthermore, special immersion containers have been developed for introducing the magnesium or magnesium master-alloy into the base melt.

Another arrangement used in an attempt to reduce the oxidation of the magnesium consists in the use of special pouring ladles which have a feed opening at the bottom of the ladle through which the molten magnesium is pressed into the base melt. Lance injectors were also developed whereby fine-grained magnesium was blown into the melt by means of an inert carrier gas.

The basic problem with all of these solutions is that very elaborate apparatuses are required. Thus, it is not a satisfactory solution of this problem to use apparatuses or arrangements which are complicated and partly trouble-prone or costly. Also, unsatisfactory results were obtained when it was attempted to use coal impregnated with magnesium or to use magnesium alloys of high specific weight and to cover the alloys after they were placed in the empty pouring ladle by pouring molten iron over them or by introducing the alloys to the melt by means of the dipping process. The magnesium or the magnesium master-alloy, after being placed in the empty pouring ladle, was covered by sandwiching between a variety of material, such as, coke, sheet metal scraps, calcium carbide, ferrosilicon, etc., and, subsequently, the pouring ladle was filled with the molten base iron. However, this procedure did not reduce the amount of oxidation sustained. Those same problems apply analogously to processes using covering slags and slag electrolysis.

SUMMARY OF THE INVENTION

The present invention provides a method for effectively reducing the magnesium oxidation in the production of cast iron containing globular graphite as well as improving the properties of the iron using simple apparatus and engineering methods.

This is accomplished by pouring molten iron onto magnesium or a magnesium master-alloy which is covered by particulate silicon carbide and iron chips or iron shavings. In other words, molten base iron is not directly brought into contact with the magnesium or the magnesium master-alloy, but rather, with a magnesium or magnesium master-alloy which is coated or covered, e.g., as by sandwiching, by particle-shaped silicon carbide and iron chips. Hereinafter, the magnesium and/or magnesium master-alloy will sometimes be referred to collectively as magnesium.

DESCRIPTION OF THE PREFERRED EMBODIMENTS

In the known method of covering the magnesium with ferrosilicon and iron pieces, the covering layer must be kept as thin as possible due to the cooling of the molten iron by the covering material and this results in promoting the magnesium oxidation. In contrast, the process of the present invention allows the use of a relatively thick covering layer since due to the positive heat effect or heat exchange between the silicon carbide and the molten base iron, the cooling, which would otherwise occur, is avoided.

The silicon carbide used in the present invention generally has an average particle size in the range of approximately 1 to 70 mm, preferably 2 to 40 mm, although silicon carbide having a larger or smaller particle size could be used, if desired. Preferably, at least 60% by weight of the silicon carbide consists of particles in the range of about 1 to 70 mm and preferably about 2 to 40 mm.

As the silicon carbide, metallurgical silicon carbide is preferably used, i.e., a silicon carbide having a SiC-content of approximately 90% by weight or more. However, the process can also be performed with silicon carbide having a lower SiC-content, for example, as low as about 70% by weight SiC. Silicon carbide having an even lower SiC-content than 70% can be used for certain purposes. The nature of the remainder depends on what the silicon carbide has been used before usually the remainder consists predominantly of $SiO_2$, minor amounts of $Al_2O_3$, if any and mineralic contaminations.

The desired grain size of the SiC can be adjusted by various methods, e.g., by grinding silicon carbide fragments (for example, high-grade chill fragments) or by granulating silicon carbide wastes in the form of fine dust.

The amount of silicon carbide used is from about 0.5 to 10% by weight, preferably, 1 to 5% by weight, relative to the molten iron, or in an amount from about 50 to 250% by weight, preferably 70 to 150% by weight, relative to the magnesium. When the magnesium is arranged on the bottom of a pouring ladle, a silicon carbide covering of at least approximately 5 cm thickness is preferred.

As the iron chips, GGG-chips, preferably annealed chips, are used. However, also GGL-chips or any other type of iron or steel chips can be used. As used herein, GGG and GGL refer to cast iron containing globular and laminar graphite, respectively. The iron particles are preferably arranged as the layer farthest away from the magnesium even though a reverse arrangement or a covering of a mixture is possible. The iron particles are generally used in an amount of up to approximately 20% by weight and preferably in an amount of 5 to 10% by weight, relative to the base iron.

As already stated above, additional heat for the melting of the silicon carbide used is not required since the heat being set free compensates for any temperature loss.

When chips are used, the temperature of the base iron has to be adjusted so that there is sufficient heat for melting of the chips. For example, when the amount of chips is approximately 5 weight percent and the amount of base iron is approximately 1.5 tons, a temperature loss of approximately 70° C. is to be expected. Moreover, the time from the termination of filling the pouring ladle to the termination of the magnesium reaction should not be less than 60 seconds.

By means of the present process, it is possible to significantly reduce the oxidation of magnesium. According to a preferred embodiment, only a weakly siliconized base iron is used for carrying out the inventive process. This is an important advantage since a relatively inexpensive base iron having a low silicon content can be used in carrying out the inventive process. Accordingly, for determining the amount of the silicon carbide to be used for covering the magnesium, the desired degree of silication of the respective melt is taken into consideration at the same time. In this manner, each base iron charge can be adjusted to a silicon content according to the requirements (wall thickness) of the casting to be produced.

For carrying out the process of the present invention, melting crucibles of any kind may be used. Conventional pouring ladles are preferred, particularly, ladles having a high slenderness ratio, for example, a height:diameter ratio of 2. The usual procedure is to place in the known manner depending on the type of base iron, the required amount of magnesium, for example, FeSiMg 5 or FeSiMg 10, on the bottom of a well-heated pouring ladle. Subsequently, the magnesium is covered or coated with granular silicon carbide in an amount sufficient for covering and corresponding to the desired final silicon content of the finished GGG-iron. A layer of GGG-chips, usually in an amount of 5 to 10% of the amount of iron to be treated, may subsequently be arranged over the silicon carbide. Then the molten iron is poured in, slowly in the beginning and then with increasing speed so that the ladle is filled as quickly as possible. When steel chips are used, the resulting influence of such chips on the analysis must, of course, be taken into consideration.

The magnesium or the magnesium master-alloy may be added in the usual form, for example, in the form of bars, powder or in granular form. Grain sizes in the range of 3 to 20 mm are preferred.

The base iron should be desulfurized as much as possible to a maxiumum sulfur content of 0.010%. The silicon contents can be reduced to about 0.5%. The amount of silicon carbide used can be adjusted to achieve the silicon content of the finished iron. The technical upper limit of the silicon content is approximately 3%. The silicon carbide as used in the present invention results, in addition to a drastic reduction of the magnesium oxidation, in an improvement of the technological and mechanical properties of the GGG-iron due to the inoculating effect of the silicon carbide.

Altogether, the invention is based on the finding that in the magnesium induced production of cast iron containing globular graphite, the magnesium oxidation and the cooling of the base iron by the covering material can be successfully counteracted by using silicon carbide which has a positive heat effect.

The following examples explain the inventive process:

EXAMPLE 1

21 kg FeSiMg 5 are placed in a well preheated pouring ladle having a slenderness ratio of 1.8. The FeSiMg 5 is covered by 25 kg of silicon carbide having an average particle size of 35 mm and, finally, by 53 kg of GGG-chips. Subsequently, 1.5 tons of molten iron is poured on, first slowly and then at an increased rate. The details of the experiment and the results are shown in the following table:

| Experiment 1 | | | | | |
|---|---|---|---|---|---|
| Amount of molten iron | kg | | | 1500 | |
| FeSiMg 5 | kg | | | 21 | |
| SiC | kg | | | 25 | |
| GGG-chips | kg | | | 53 | |
| Temperature of iron in furnace °C. | | | | 1550 | |
| Duration of reaction sec. | | | | 70 | |
| Temperature of iron after reaction | | | | | |
| Temperature of iron 10 minutes later | | | | 1400 | |
| Iron analysis in furnace | | C | = 3.74 | Si | = 1.72 |
| | | P | = 0.067 | S | = 0.006 |
| | | | | Mn | = 0.12 |
| Iron analysis first sample | | C | = 3.71 | Si | = 2.70 |
| | | P | = 0.051 | Mg | = 0.030 |
| | | | | Mn | = 0.14 |
| Iron analysis second sample | | C | = 3.76 | Si | = 2.68 |
| | | | | Mg | = 0.029 |

| Experiment 2 | | | | | |
|---|---|---|---|---|---|
| Amount of molten iron | kg | | | 1200 | |
| FeSiMg 5 | kg | | | 14.4 | |
| SiC | kg | | | 25 | |
| GGG-chips | kg | | | 95 | |
| Temperature of iron in furnace °C. | | | | 1550 | |
| Duration of reaction sec. | | | | 75 | |
| Temperature of iron after reaction | | | | 1380 | |
| Temperature of iron 10 minutes later | | | | 1300 | |
| Iron analysis in furnace | | C | = 3.86 | Si | = 1.08 |
| | | P | = 0.067 | S | = 0.006 |
| | | | | Mn | = 0.12 |
| Iron analysis first sample | | C | = 3.88 | Si | = 2.14 |
| | | P | = 0.051 | Mg | = 0.033 |
| | | | | Mn | = 0.13 |
| Iron analysis second sample | | C | = 3.81 | Si | = 2.14 |
| | | | | Mg | = 0.029 |

The first sample was taken after the reaction was terminated and the slag was removed. The second sample was taken 10 minutes later. When normal pouring is performed without covering the master-alloy, a residual magnesium content of 0.020% results.

The GGG-chips have a silicon content of 2.6%.

What is claimed is:

1. A process for producing cast iron containing globular graphite comprising covering magnesium or a magnesium master-alloy with a material to prevent oxidation of the magnesium or magnesium master-alloy, said material being particulate silicon carbide and a material selected from the group consisting of iron and steel chips, the particulate silicon carbide forming a layer closest to the surface of the magnesium or magnesium master-alloy and the said iron or steel chips forming a second layer covering the particulate silicon carbide such that the silicon carbide and said chips form consecutive layers and then pouring molten iron onto the thus covered magnesium or magnesium master-alloy.

2. The process of claim 1 wherein a predominant portion of the silicon carbide has a particle size in the range from about 1 to 70 mm.

3. The process of claim 1 wherein the silicon carbide has a particle size in the range from about 2 to 40 mm.

4. The process of claim 1, 2, or 3 wherein the particulate silicon carbide contains more than about 70% by weight silicon carbide.

5. The process of claims 1, 2, or 3 wherein the particulate silicon carbide contains more than 70% by weight metallurgical silicon carbide.

6. The process of claims 1, 2, or 3 wherein the molten iron is weakly siliconized.

7. The process of claims 1, 2, or 3 wherein the particulate silicon carbide contains more than about 70% by weight silicon carbide and the remainder is $SiO_2$, minor amounts of $Al_2O_3$ and mineral contaminating material.

8. The process of claims 1, 2, or 3 wherein the particulate silicon carbide contains more than about 70% by weight metallurgical silicon carbide and the remainder is $SiO_2$, minor amounts of $Al_2O_3$ and mineral contaminating material.

9. The process of claims 1, 2, or 3 wherein the molten iron is siliconized in an amount from about 0.1 to 1.0 percent by weight.

* * * * *